US007234240B2

(12) United States Patent
Peter et al.

(10) Patent No.: US 7,234,240 B2
(45) Date of Patent: Jun. 26, 2007

(54) ELECTRICAL HAIR CARE OR REMOVAL APPLIANCE

(75) Inventors: Andreas Peter, Kronberg (DE); Werner Haczek, Idstein (DE); Thosten Piesker, Bad Homburg (DE); Stefan Fürst, Kronberg (DE); Andreas Hartmann, Mainz (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 10/969,271

(22) Filed: Oct. 20, 2004

(65) Prior Publication Data

US 2005/0050732 A1 Mar. 10, 2005

Related U.S. Application Data

(63) Continuation of application No. PCT/EP02/14276, filed on Dec. 14, 2002.

(30) Foreign Application Priority Data

Apr. 22, 2002 (DE) ..... 102 17 987

(51) Int. Cl.
*B26B 19/40* (2006.01)

(52) U.S. Cl. ..... 30/41; 30/41.5; 30/41.6; 222/400.5

(58) Field of Classification Search ..... 30/41, 30/41.5, 41.6; 134/115 R; 15/20, 24, 29; 222/192, 400, 400.5; 401/263; 132/112, 132/119.1, 272; 118/684; 433/131
See application file for complete search history.

(56) References Cited

U.S. PATENT DOCUMENTS 3,299,506 A * 1/1967 Gwinn ..... 30/41
3,359,634 A * 12/1967 Beck ..... 30/41
3,421,215 A * 1/1969 Bauer ..... 30/41
3,977,084 A * 8/1976 Sloan ..... 433/131
4,031,618 A * 6/1977 Mansfield ..... 30/41.5
5,121,541 A 6/1992 Patrakis ..... 30/41
6,308,413 B1 * 10/2001 Westerhof et al. ..... 30/41
6,312,436 B1 * 11/2001 Rijken et al. ..... 606/133
6,594,905 B2 * 7/2003 Furst et al. ..... 30/41
RE38,634 E * 10/2004 Westerhof et al. ..... 30/41

FOREIGN PATENT DOCUMENTS

DE 1 703 785 3/1972
DE 26 58 695 6/1978
DE 199 07 025 8/2000
FR 2 634 154 7/1988

* cited by examiner

*Primary Examiner*—Boyer D. Ashley
*Assistant Examiner*—Carolyn T Blake
(74) *Attorney, Agent, or Firm*—Fish & Richardson P.C.

(57) ABSTRACT

The invention is directed to an electrical appliance, in particular an appliance for hair removal or hair care, with at least one electric power unit, an electric circuit connected thereto and including an On/Off switch, and a fluid circuit feeding a fluid from a reservoir to an application site which is open to atmosphere and where fluid is withdrawn from the fluid circuit, wherein the On/Off switch, in overcoming an actuator travel, is switchable between two end positions and is coupled to an actuator of a shutoff valve of the fluid circuit.

8 Claims, 4 Drawing Sheets

ELECTRICAL HAIR CARE OR REMOVAL APPLIANCE

CROSS-REFERENCE TO RELATED APPLICATIONS

This is a continuation of PCT Application No. PCT/EP02/14276, filed on Dec. 14, 2002, which claims priority to German Patent Application No. 102 17 987.5, filed on Apr. 22, 2002, which is incorporated herein by reference in its entirety.

TECHNICAL FIELD

This invention relates to an electrical appliance, in particular an appliance for hair removal and/or hair care, with at least one electric power unit, an electric circuit connected thereto and including an On/Off switch, and a fluid circuit feeding a fluid from a reservoir to an application site which is open to atmosphere and where fluid is withdrawn from the fluid circuit.

BACKGROUND

An electrical appliance of this type in the form of an electric shaving apparatus is known from DE 199 07 025 A1. The known appliance has an electric motor arranged in a housing and driving both the shaving unit of the shaving apparatus and a pump device. This pump device supplies a shaving and/or care fluid to an applicator element adapted to apply the fluid to the skin to be shaved or the hair. When the shaving unit is turned off, the pump device is also stopped, so that no more fluid is conveyed from the reservoir. However, it is still possible for fluid to leak out of the supply pipe connecting the fluid reservoir directly with the applicator, at least when the shaving apparatus is maintained in an inverted position for a prolonged time. It is also possible for fluid to escape undesirably through the throttle leading from the fluid reservoir to atmosphere.

It is therefore an object of the present invention to provide an electrical appliance which absolutely reliably prevents any inadvertent escape of fluid from the fluid circuit in particularly straightforward manner, with particularly low constructional effort, and with a minimum number of components.

According to an aspect of the present invention, this object is accomplished by providing for the On/Off switch to be switchable between two end positions, in particular between two stable end positions, in overcoming an actuator travel and to be coupled to an actuator of a shutoff valve of the fluid circuit.

The present invention may find application in a wide variety of electrical appliances which have a fluid circuit in addition to the electric circuit. These include, among other appliances, electric shavers affording the possibility of fluid application, epilators having such a fluid application possibility, steam irons, coffee or espresso makers or fluid-applying hair dryers or curling irons.

SUMMARY

A bistable pressure switch which has a cam control for controlling the actuator travel is preferably used as the On/Off switch. These pressure switches with cam controls of the type known, for example, from ball-point refills for generating their advancing movement, afford the advantage of creating an appreciable actuator travel in spite of compact construction, which can then be used effectively for actuation of the shutoff valve.

According to an embodiment of the invention which is of particularly straightforward construction and insusceptible to failure, the shutoff valve is realized as a clamping element capable of clamping together or releasing a hose section of the fluid circuit in dependence upon the position of the switch.

In another preferred embodiment of the invention, the shutoff valve is constructed as a seat valve or as a slide valve, in particular as a 2/2 directional control valve. The advantage of this embodiment is that it exhibits a particularly accurate control and switching characteristic and that the opening and closing behavior of such valves has no hysteresis and/or aging effects.

The On/Off switch may be manufactured particularly easily and with a very low number of components when it is acted upon by an interrupter spring which itself is part of an electric switching contact of the switch. Advantageously, the switching contact itself is then fabricated from an elastic material such as, for example, spring bronze.

Advantageously, the On/Off switch is coupled to an actuating rod one end of which forms the shutoff element of the shutoff valve. In order to ensure particularly reliable operation, it is an advantage for the actuating rod to be loaded by a spring element. When the spring element acts upon the shutoff valve in the closing direction, this reliably prevents fluid from escaping even in cases when components of the switching chain are defective. This additional spring element relieves the interrupter spring and enables the use of a two-part actuating rod whose manufacturing tolerances can be absorbed by the additional spring.

Further objects, features, advantages and application possibilities of the present invention will become apparent from the subsequent description of the embodiments. It will be understood that any single feature or any combination of single features described or represented by illustration form the subject-matter of the present invention, irrespective of their summary in the claims or their back-references.

DETAILED DESCRIPTION

Figure 1:
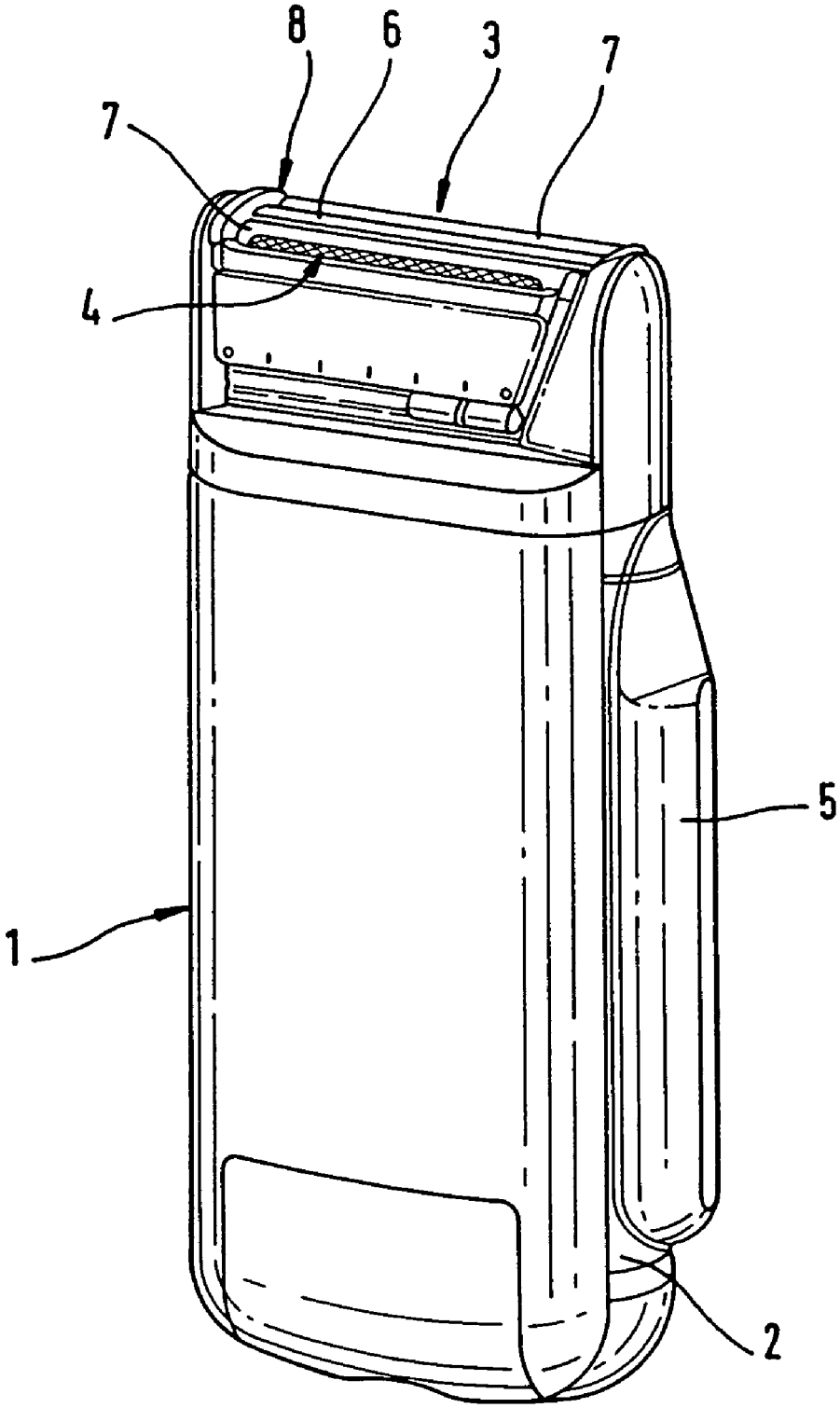
FIG. 1 is a view of a dry shaver with a fluid applicator embodying the invention.

FIG. 1 is a perspective view of a dry shaving apparatus showing the rear side of the housing 1 and one of the two narrow sides 2 of the housing 1. Provided at the upper end of the housing 1 is a shaving head 3 on which a fluid dispensing device 4 is provided. Attached to the narrow side 2 of the housing is a fluid reservoir 5. This fluid reservoir may be fixedly or detachably connected to the housing. According to the invention, it is also possible for the fluid reservoir to be arranged in the interior of the housing in a fixed or replaceable manner. The fluid dispensing device 4 enables the metered application of a suitable shaving fluid and/or lubricant during the shave, regardless of the shaver position, whereby the shaving comfort can be enhanced appreciably.

Figure 2:
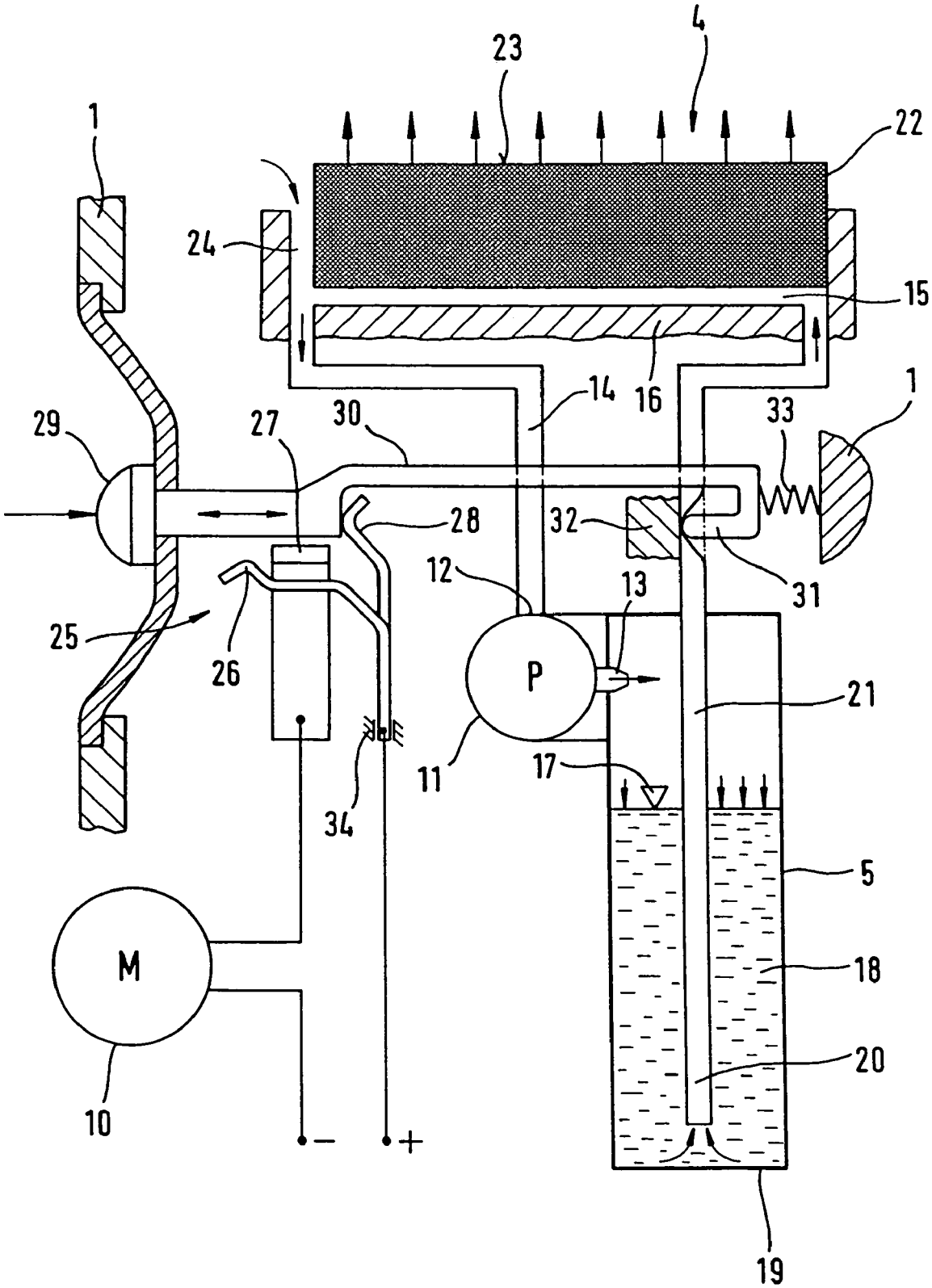
FIG. 2 is a greatly simplified, schematic view of the structural design of this embodiment.

In a manner known in the art, the shaving head 3 is comprised of a centrally located intermediate cutter 6 for shaving longer hairs. The intermediate cutter is disposed between two arched shaving foils 7 which cooperate with undercutters, not shown in the drawing, for shaving short hairs. The shaving foils 7 and the intermediate cutter 6 are mounted in a removable frame 8. The fluid dispensing device 4 is secured to this removable frame 8 to ensure that the application of fluid takes place in direct proximity to the area to be shaved. In addition to receiving the fluid reservoir 5, the housing 1 also accommodates an electric motor 10 which serves to drive the undercutters of the shaving head in an oscillatory manner as well as to drive a pump 11. The pump can be driven either directly or indirectly. According to the invention, it is furthermore possible for the pump 11 to be driven by an electric motor assigned to it separately. The pump 11 is part of a fluid system communicating with the fluid dispensing device 4, as shown in FIG. 2 and explained in greater detail with reference to that Figure.

The pump 11 serves to operate the fluid circuit, conveying fluid from the fluid reservoir 5 to the fluid dispensing device 4. For this purpose, the pump 11 has an inlet 12 and an outlet 13 with an integrated throttle. This throttle limits the operating pressure in the fluid system. Through a first fluid conduit 14, the inlet 12 is connected to the applicator pocket 15 of the fluid dispensing device 4. The pocket is constructed as an elongate recess in an applicator housing 16. This first fluid conduit 14 is connected to the applicator pocket 15 in the pocket's left-hand end section when viewing the drawing.

Advantageously, the pump 11 is arranged in the interior of the fluid reservoir 5 which is constructed as a replaceable cartridge and is exchanged for a new one when the fluid is spent.

Depending on the amount of fluid consumed, the fluid reservoir 5 is filled with fluid 18 up to a specified level 17, and the region below the maximum fluid level may be filled with a storage material for improved binding of the fluid. Open-cell sinter materials are particularly suitable for this purpose. Terminating in close proximity to and above the bottom 19 of the fluid reservoir 5 is a riser 20 which presents part of a second fluid conduit 21. The fluid conduit 21 leads to the applicator pocket 15 to which it is connected in the pocket's right-hand end section when viewing the drawing.

The applicator element 22 is arranged in a firm press-fit in the applicator pocket 15 such that the upper region on which an applicator surface 23 is provided protrudes over and beyond the applicator housing 16. The press fit between the applicator element 22 and the applicator housing 16 is only interrupted by at least one secondary-air duct 24 having an accurately defined flow cross-section. The applicator element 22 may be fabricated from a wick-type material or from a metal or plastics sinter material. Owing to its open-cell structure, it possesses a capillary effect for liquids leading to complete wetting. For operation of the fluid system, it is important for the cross-section of the secondary-air duct 24 to be matched exactly to the throttle in the pump outlet 13.

In FIG. 2, the On/Off switch 25 is shown in the Off position. Accordingly, it can be seen that, in this position, the contact lug 26 is spaced from the contact element 27. Through interposition of the electric motor 10, the contact element 27 is connected to the negative terminal of a source of current, while the contact lug 26 is connected to its positive terminal. The interrupter spring 28 loads the pushbutton 29 of the On/Off switch 25 into the Off position. The contact lug 26 and the interrupter spring 28 are integrally formed and fabricated from an elastic material. At its end remote from the pushbutton 29, the interrupter spring 28 is held with bias in a clamping device 34 formed fast with the housing. When the pushbutton 29 is actuated in the On direction (that is, towards the right in FIG. 2), the interrupter spring is moved in opposition to its biasing direction. This movement is simultaneously transferred to the contact lug 26, which moves in the direction of the contact element 27, contacting it in electrically conducting fashion. This completes the electric circuit, turning the motor on.

Connected to the pushbutton 29 is an actuating rod 30 whose end remote from the pushbutton 29 is constructed as a clamp wedge 31. The second fluid conduit 21 is passed between this clamp wedge 31 and its abutment 32. The second fluid conduit 21 is of a hose-type configuration at least in the region of the clamp wedge 31. This hose-type configuration is obtained using an elastic hose material compressible with low forces. The actuating rod 30 is loaded by a spring 33 taking support from the housing to which it is joined firmly.

In the Off position shown in FIG. 2, the electric motor 10 is turned off and the fluid conduit 21, compressed by the clamp wedge 31, is pressed against the abutment 32 in such a manner that fluid is not allowed to pass this point. Only when the pushbutton 29 is depressed does the pushbutton move to the right together with the actuating rod 30. This motion causes the electric contact between the contact lug 26 and the contact element 27 to be closed and also displaces the clamp wedge 31 in opposition to the force of the spring 33 opening the flow cross-section between the wedge and the abutment 32.

This arrangement ensures that fluid is not allowed to escape from the fluid reservoir 5 even when the electric shaver is in an inverted position. Because the throttle of the fluid system is disposed in the pump outlet 13, that is, within the fluid circuit, thereby obviating the need to provide a pressure-relief valve towards atmosphere, the fluid circuit is completely sealed against atmosphere when the appliance is deactivated. In this condition, the turned-off pump 11 prevents any fluid from escaping through the first fluid conduit 14.

When the motor 10 of the electric shaver is turned on by the On/Off switch 25, it drives both the undercutters of the shaving head 3 and the pump 11. Through the first fluid conduit 14, the pump 11 initially draws air from the applicator pocket 15. Like the applicator element 22, the applicator pocket 15 contains no fluid initially. This enables aspirated air to be further supplied through both the pores of the applicator element and the secondary-air duct. This air is forced into the fluid reservoir 5 through the outlet 13 of the pump 11 and the throttle arranged in the outlet. The resulting pressure rise causes fluid 18 to be transferred via the riser 20 or the second fluid conduit 21 to the applicator pocket 15.

Once the fluid has reached the applicator pocket 15, a fluid stream develops in the lower region of this pocket, that is, between the mouths of the first and second fluid conduits. By virtue of its capillary effect, the arriving fluid is distributed in the entire applicator element 22 and transferred to the applicator surface 23. Any excess fluid that the applicator element 22 is unable to take up is extracted by the pump 11 through the first fluid conduit 14 and returned to the fluid container 5.

As long as the applicator element is still relatively dry and its pores mainly open, a very large volume of air is drawn by the pump 11, which results in a very rapid pressure increase in the fluid reservoir 5. This leads to a very rapid transfer of the fluid 18 to the applicator pocket 15. With the fluid volume fed to the applicator element 22 increasing, its pores are gradually filled with fluid, and the secondary-air duct 24 is gradually closed by fluid. From this moment on, an operating state prevails in which initially no additional air can be aspirated into the fluid system. The applicator pocket 15 is prevented from overflowing and only a fluid circuit is maintained in circulation. Not until a certain amount of fluid has been dispensed through the applicator surface 23 is air again allowed to be supplied to the system through correspondingly evacuated pores or a released secondary-air duct 24. This aspirated air volume then replaces the dispensed amount of fluid. The circulation system thus ensures that, during operation, the applicator element 22 is at all times sufficiently wetted, receiving an adequate supply of fluid 18.

Figure 3:
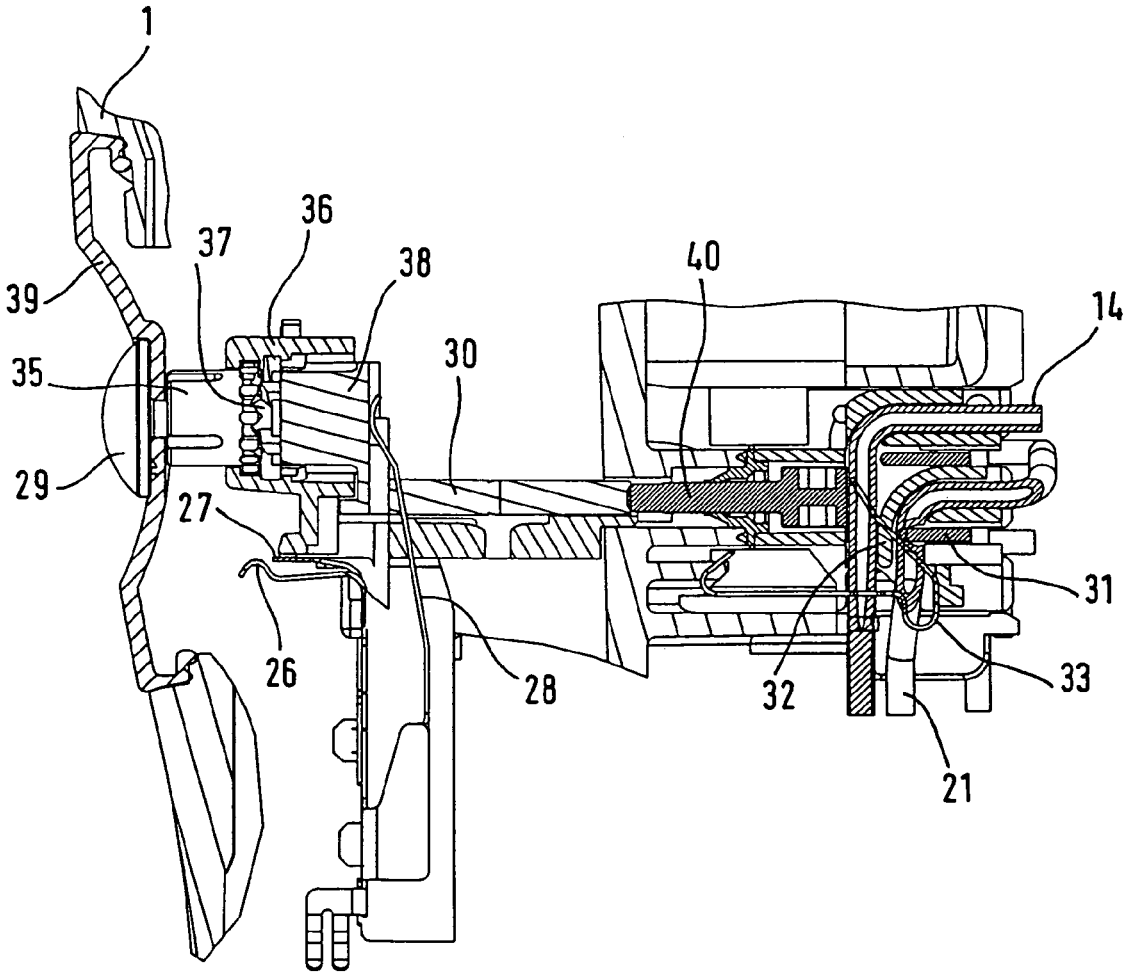
FIG. 3 is a detailed view of another embodiment of the invention.

FIG. 3 shows another embodiment of the On/Off switch 25 and the shutoff element, coupled thereto, for the fluid conduit 21. The On/Off switch is comprised of a pushbutton 29 coupled to a first camming element 35. This first camming element 35 is situated in a stationary guideway 36 as is a second camming element 37 which is arranged between the first camming element 35 and an end piece 38 of the On/Off switch 25. The end piece 38 is guided in the teeth of the guideway 36 in a non-rotating relationship thereto and has an actuating rod 30 integrally formed thereon at its end facing away from the pushbutton 29. The camming elements 35 and 37 have facing spur teeth extending annularly around the circumference and having tips and roots. The second camming element 37 is rotatable relative to the first camming element 35 and the end piece 38 about the symmetry axis. Depending on whether the respective tips of the two gears stand end to end or whether the gears are in meshing engagement, a respective distance defining the actuator travel between the first camming element 35 and the end piece 38 will be set. Such camming elements are known in the art, for example, from the actuation of ballpoint refills to produce the advancing movement of these refills.

FIG. 3 shows the Off position of the On/Off switch 25. In this position, the distance between the first camming element 35 and the end piece 38 is the minimum possible distance because the teeth of the first and second camming element are in meshing engagement. In this state, the contact between the contact lug 26 and the contact element 27 is open. The pushbutton 29 is surrounded by a membrane 39 connected to both the pushbutton and the housing 1 in a sealed relationship. The end piece 38 is elastically biased towards the pushbutton 29 by the interrupter spring 28.

As already explained with reference to FIG. 2, the interrupter spring 28 and the contact lug 26 are integrally made of one piece and secured to the housing. Adjoining the actuating rod 30 is an intermediate member 40 which is biased towards the actuating rod 30 by means of the spring 33. In its end region facing away from the actuating rod 30, the intermediate member 40 has a clamp wedge 31 reaching behind the hose-shaped elastic section of the second fluid conduit 21. Owing to the bias of the spring 33, this clamp wedge 31 is urged to the left onto the fluid conduit 21 with such a high force that it compresses the fluid conduit, closing the fluid passage. As this occurs, the clamp wedge 31 forces the fluid conduit 21 against the abutment 32 constructed as hose guideway. Both the actuating rod 30 and the intermediate member 40 are mounted for longitudinal displacement in the housing 1.

When the pushbutton 29 is depressed for a first time, the second camming element 37 rotates relative to the first camming element 35 through a predetermined angle, causing the respective tips of the two gears to lie end to end. As a result, an additional distance defining the actuator travel is set between the pushbutton 29 and the end piece 38. Due to the displacement of the end piece 38 in the guideway 36 against the force of the interrupter spring 28, electrical contact between the contact lug 26 and the contact element 27 is closed. In addition, the actuating rod 30 is displaced to the right. The rod then displaces the intermediate member 40 and the clamp wedge 31 to the right against the force of the spring 33, thus canceling the clamping action on the second fluid conduit 21. When the pushbutton is pressed a second time, the off-state shown in FIG. 3, in which the electric contact is open and the fluid conduit 21 is closed by being clamped together, is resumed.

Figure 4:
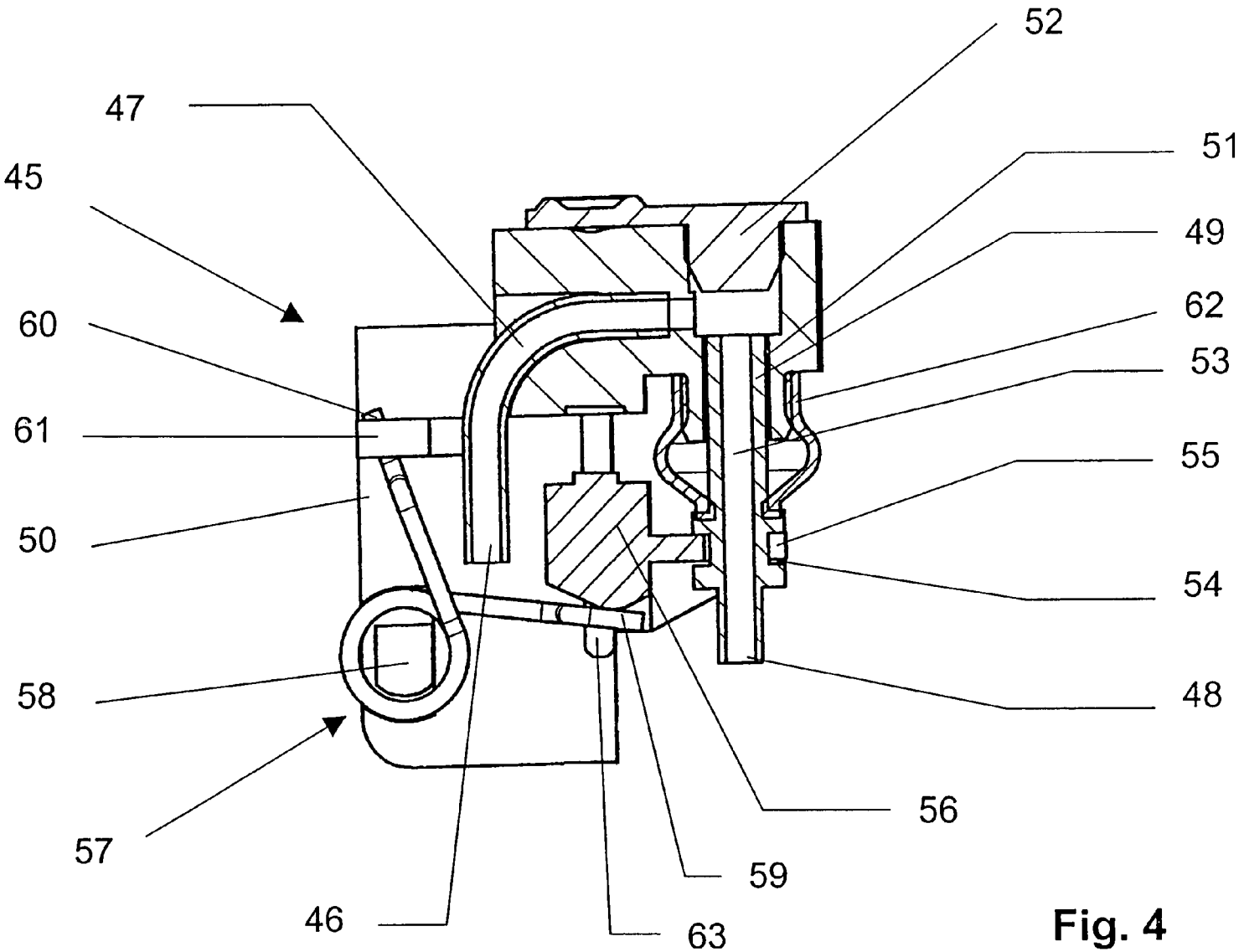
FIG. 4 is a sectional view of a seat valve.

In an alternative embodiment of the invention, the switching valve 45 shown in FIG. 4 is integrated into the second fluid conduit 21. The free end 46 of the arcuate connecting pipe 47 connects the switching valve 45 with the reservoir, while the free end 48 of the substantially tubular valve closure element 49 communicates with the applicator pocket 15 of the fluid dispensing device 4 through the second fluid conduit 21. The valve closure element 49 is guided in the valve housing 50 in a through-bore 51 out of which it protrudes with its end 48. The end of the through-bore 51 opposite the valve closure element 49 is closed by an elastomeric sealing seat 52. The central bore 53 of the valve closure element can be closed by engagement of the valve closure element 49 with the sealing seat 52. In this state, the connection between the fluid reservoir 5 and the fluid dispensing device 4 is interrupted.

Provided on the outer contour of the valve closure element 49 in the area of the end 48 is a circumferential groove 54 which is engaged by a coupling yoke 55 constructed as part of an actuating head 56. The actuating head 56 in turn is connected to the actuating rod 30—see FIG. 2.

A leg spring 57 is held on a bar-type projection 58 of the valve housing 50, with the coil-type center portion of said leg spring 57 embracing the projection 58. In this arrangement, the first leg 59 of the leg spring 57 elastically biases the actuating head 56 in a direction effecting closing of the valve closure element 49 coupled thereto. To this effect, the end of the second leg 60 takes support upon a stop 61 of the valve housing 50. In the representation of FIG. 4, the switching valve 45 is open. When the pushbutton 29 was depressed, the actuating head 56 was displaced by the actuating rod 30 in opposition to the force of the leg spring 57. As a result of which, the valve closure element 49 was caused to move into a direction away from the sealing seat 52. The first leg 59 or the actuating head 56 then rests in an end position against a stop 63. When switching off with the pushbutton 29, the pressure force exerted by the actuating rod 30 is no longer present. The actuating head 56, driven by the pressure force of the leg spring 57, is moved back and the valve closure element 49 is urged into engagement with the valve seat 52. Communication between the fluid reservoir 5 and the fluid dispensing device 4 is thus closed again.

In contrast to the hose clamping according to FIGS. 2 and 3, the switching valve 45 of FIG. 4 dispenses with the sealing function obtained by deformation of the elastomeric hose section, resulting in an increased switching accuracy with active opening of the valve 45. The use of the leg spring 57 enables a large actuator travel of the valve, which is necessary when the actuation is to take place with a considerable extra stroke by a cam control with a camming element according to FIG. 3—see in this Figure the first camming element 35, the guideway 36, the second camming element 37 and the end piece 38.

The section of the valve closure element 49 extending out of the valve housing 50 up to the groove 54 is encapsulated by an elastomeric bellows 62. This bellows 62 also serves as a valve spring acting in opening direction—though with a low spring force. As a result, the switching valve 54 operates in particularly clearance-free manner, enabling extremely short actuator travels to be realized.

The invention claimed is:

1. An electrical hair care or removal appliance comprising:

at least one electric power unit with an electric circuit connected thereto and including an On/Off switch and a fluid circuit configured to feed a fluid from a reservoir to an application site which is open to atmosphere and where fluid is withdrawn from the fluid circuit;

a shutoff valve located in the fluid circuit, the shutoff valve operable to limit flow of the fluid from the reservoir to the application site, the shutoff valve comprising a clamping element that clamps and releases an elastic hose section of the fluid circuit; and an actuating rod having a first end mechanically coupled to the On/Off switch and a second end forming the clamping element of the shutoff valve;

wherein the On/Off switch is switchable between two end positions and is coupled to an actuator of the shutoff valve of the fluid circuit such that when the On/Off switch is in a first position, the shutoff valve is in a closed position, and when the On/Off switch is in a second position, the shutoff valve is in an open position.

2. The electrical appliance as claimed in claim 1, wherein the On/Off switch comprises a bistable pressure switch having a cam control for controlling the actuator.

3. The electrical appliance as claimed in claim 1 further comprising an interrupter spring which is part of an electric switching contact, the interrupter spring acting on the On/Off switch.

4. The electrical appliance as claimed in claim 1, wherein the actuating rod is biased by a spring element.

5. The electrical appliance as claimed in claim 4, wherein the spring element biases the actuating rod in a closing direction of the shutoff valve.

6. An electrical hair care or removal appliance comprising:

a housing;

a fluid system comprising a reservoir contained within the housing, an applicator element at least partially exposed at the surface of the housing to dispense a fluid, a conduit providing a fluid connection between the reservoir and the applicator element, and a valve disposed between the reservoir and the applicator element, the valve comprising a clamping element that clamps and releases an elastic hose section of the conduit;

a switch manually operable to selectively turn a electric motor on and off, the switch mechanically coupled to the valve; and an actuating rod coupled to the switch, the rod having a first end mechanically coupled to the switch and a second end forming the clamping element of the valve;

wherein manual operation of the switch to turn the motor off closes the valve thus stopping fluid flow from the reservoir to the applicator element.

7. The electrical hair care or removal appliance of claim 6 wherein manual operation of the switch to turn the motor on opens the valve thus permitting fluid flow from the reservoir to the applicator element.

8. The electrical hair care or removal appliance of claim 7 wherein the switch comprises a bistable pressure switch including camming elements.

* * * * *